US005699557A

United States Patent [19]

Johnson

[11] Patent Number: 5,699,557

[45] Date of Patent: Dec. 23, 1997

[54] EMBROIDERED APPLIQUE FASTENING SYSTEM CLOTHING ARTICLES

[76] Inventor: Marie M. Johnson, 5026 Inglewood Ct., Nashville, Tenn. 37216

[21] Appl. No.: 494,676

[22] Filed: Jun. 26, 1995

[51] Int. Cl.[6] ..... A41B 11/00; A41D 27/08

[52] U.S. Cl. ..... 2/239; 2/912; 2/244; 24/444

[58] Field of Search ..... 2/239, 912, 913, 2/916, 275, 911, 918, 919, 155, 156, 144, 159, 160, 240, 241, 336, 244, 265; 24/DIG. 29, 442, 444, 446, 447, 450

[56] References Cited

U.S. PATENT DOCUMENTS

| | | | |
|---|---|---|---|
| 4,165,555 | 8/1979 | Boxer et al. | 2/239 |
| 4,672,722 | 6/1987 | Malamed | 24/446 |
| 4,710,979 | 12/1987 | Bull et al. | 2/913 |
| 4,745,924 | 5/1988 | Ruff | 128/686 |
| 4,820,164 | 4/1989 | Kemper | 2/919 |
| 4,975,985 | 12/1990 | Stimpson | 2/115 |
| 5,038,413 | 8/1991 | Ursino | 2/239 |
| 5,046,193 | 9/1991 | Foresman et al. | 2/918 |
| 5,321,855 | 6/1994 | Ciuffo | 2/912 |
| 5,359,733 | 11/1994 | Brannon et al. | 2/918 |
| 5,359,734 | 11/1994 | Rathburn | 2/918 |

*Primary Examiner*—Amy B. Vanatta

*Attorney, Agent, or Firm*—Wascher & Thomas, PLLC; Rick R. Wascher; Laura K. Thomas

[57] ABSTRACT

A pair of fastening hook-and-loop patches, consisting of a flexible and decorative hook patch and a flexible and decorative loop patch is permanently attached to a mated pair of complementary items by embroidery which provides enhanced attachment and resistance to curling and inadvertent disassociation with the article of clothing. The mated pairs of complementary items may include articles of clothing or other articles of manufacture. The decorative embroidered applique patches on a single pair of complementary items are unique and aid in mating assorted individual complementary items based on the shape and color of the fastening patch embroidered to the complementary item. The decorative nature of the patches is useful in attracting a child's attention to the fastening device, which results in the child's interest in participation in mating items, such as socks, which may be separated from their complementary mates.

15 Claims, 6 Drawing Sheets

EMBROIDERED APPLIQUE FASTENING SYSTEM CLOTHING ARTICLES

BACKGROUND OF THE INVENTION

1. Field of the Invention

The present invention relates generally to an applique fastening system for holding socks together during laundering or storage, etc. The applique is fastened to the sock material by embroidery which is known to be more durable and provides several advantages over other methods of attachment.

2. Description of the Related Art

It will be appreciated by those skilled in the art that the problem of unmatched socks, gloves, and the like plagues all who attempt to use, launder or store paired items of apparel. There have been several attempts to surmount this problem which provide various means for fastening two paired items of apparel or manufacture together prior to laundering or storing.

One such attempt was disclosed in U.S. Pat. No. 4,165,555 which teaches the use of a pair of flexible loop patches and flexible hook patches that are hinged together to provide a hook-and-loop strip for one of a pair of items and a complementary hook-and-loop strip for the other of the pair. The invention disclosed in '555 describes longitudinal strips of hook-and-loop material which have no inherent decorative appeal.

Another attempt was disclosed in U.S. Pat. No. 4,058,853, incorporated by reference as if fully set forth herein, directed to socks with flexible self-contained fastener patches. The '853 patent includes hook and pile patches attached to the sock material. The hook and pile patches are, however, attached to the sock material by simple sewing. The '853 patent is also directed to hook and pile patches having a flap for protecting the hook and pile material when the mating combination of two patches is not in use.

Yet another attempt was disclosed in U.S. Pat. No. 5,038,413 which covers a snap-type of fastening means for securing a pair of socks together. The '413 patent describes a fastener which has a decorative appearance, but which presents the problem of having a raised profile due to the snap protrusion. The wearer may find the sock uncomfortable to wear as the snap protrusion may dig into the wearer's leg.

What is needed, then, is an attractive and comfortable to wear system for fastening pairs of clothing or other items together, and which is unique in color and shape to facilitate the sorting of different pairs of items by means of matching the different shaped and colored fasteners. In addition, a fastener system capable of withstanding repeated washing and drying cycles known to cause conventional means of attachment to curl and limit the utility of the fastener because of the manner in which it is attached to the garment. Further, an aesthetically pleasing fastener system is needed so that all persons, particularly young children, will be encouraged to utilize this method of pairing clothing items or items of manufacture together as a result of the attractive appearance of the fasteners. Finally, the use of a fastening system which utilizes letter or number shapes can facilitate teaching small children their numbers or letters. This system of attachment to prevent or minimize the negative effects of successive washing and drying cycles is presently lacking in the art to which the invention relates.

SUMMARY OF THE INVENTION

The general object of this invention is to provide a fastening system for pairs of socks which is both attractive to the eye and comfortable to wear. Further, it is of paramount importance to provide a system of attaching the fasteners to the sock themselves in such a way as to resist curling or disengagement of the fastener from the sock material.

To this end, the paired socks are provided with applique fasteners which are cut in various shapes, including by means of die-cutting, and are permanently attached by means of computerized embroidering equipment which completes the design. First embroidery will not unravel like conventional stitching commonly found in sewing applications. A variety of embroidery patterns may be used in order to accurately and securely attach the fastener to the sock and thus avoid shape dependent limitations. Similarly, a plurality of embroidery patterns may be used to provide optimal attachment and resistance to curling and separation of the fastener from the sock material. Examples of such patterns include, walk, running, zig-zag or columned embroidery. Conventional sewing incorporate a stitch density of about 8–10 stitches per inch and embroidered satin or columned stitches incorporates a stitch density of about 65–100 stitches per inch.

Considering that many of the commercially available embroidery machines incorporate a multitude of needles (e.g., nine) an intricate pattern of attachment may be achieved which is far superior to simple border stitching associated with sewing applications. In addition, several thread colors may be utilized at one time as compared to a single thread color limitation associated with sewing.

The present invention also includes aesthetic appealing embroidery in order that the appearance of the sock is enhanced so the socks are more attractive despite the utility of the fasteners being securely attached to the sock material by embroidery. Hence, the added the embroidery component of the present invention is critical to the secure attachment of the fastener to the sock as well as to add visual appeal to the sock itself.

During the manufacturing process, using a common sock as an example, the embroidery machine first stitches an outline onto the sock material to indicate the relevant placement of the embroidered applique fastener. The fastener is positioned on the sock at the sewn outline. Because the fastener is die cut and has a raw edge, which tends to unravel if left uncovered and unprotected all around its periphery, a column or satin stitch is then used to secure the fastener to the sock and covers the raw edge of the fastener.

After the applique is attached to the sock, the embroidery machine completes the embroidered applique design with as many as nine colors to provide the appropriate means of attachment of the fastener to the sock and achieve the appropriate aesthetic appearance desired.

Furthermore, another important advantage of embroidery is the ability of the embroidery to raise the pile on the hook side of the fastener making it less likely to catch lint and inadvertently stick to other articles of clothing through casual contact with them during the wash or dry cycles. That is, by raising the relative pile of the hook material the user of the present invention must forcibly join the mating portions of the hook and loop material in order to make them engage one another. The forcible interengagement causes the attached socks to stay securely attached, and thus, the raised pile of the hook actually resists attachment to other articles of clothing because of the embroidered attachment system.

Yet another advantage of the embroidered attachment of the fastener is the ability of the user to easily distinguish one persons sock from those of another. For example, if the embroidered attachment system included figures or monograms, the socks belonging to one person would not be confused with the socks of another. In addition, some people are quite meticulous and prefer that pairs of sock undergo the same amount of wear during their useful life. Conventional means of attaching socks do not ensure that the proper mates of a pair of socks are always joined. Embroidering the fastener to the sock material therefore aids in the proper mating of the socks to ensure combined wear and the same worn appearance after successive wearing of the sock.

In addition, another advantage to embroidery is the ability to use reflective or brightly (e.g. neon) colored threads. Such threads may be used to embroider safety symbols or large designs which may be visible, for example, by oncoming motor vehicle traffic if the socks were worn with shorts by a child playing outside near a street at dusk or night.

The present invention provides yet another advantage in that ornate or decoratively color distinctive trademarks and logos may be applied to the article of clothing and held in a secure manner by the embroidered stitches.

Following the general objects and advantages of the invention, applique fasteners are fabricated out of a flexible hook and loop material and attached through the use of embroidery to the garment material. In accordance with the teachings of the invention, applique fasteners are cut in a wide variety of decorative shapes.

The embroidered applique fastening system in accordance with the invention has many advantages and features. In addition to being very convenient and comfortable, the fastening system provides a highly attractive and decorative appearance when worn. Further, the fastening system can be used by everyone including adults and children. Socks which are provided with the embroidered applique fasteners are inexpensive to manufacture. Thus, the socks with their accompanying decorative appeal as well as the fastening feature are reasonably priced for the consumer. In addition, if the article of clothing might undergo or experience shrinking, the embroidered attachment of the fastener resists curling and deformation due to its secure attachment at various places, which has the overall tendency to resist shrinking at least in the area of the fastener. Resistance to shrinking therefore, ensures the longevity of the usefulness of the fastening system.

Finally, the decorative nature of the embroidered applique fastener along with the easy manner with which the fastening means may be adhered to one another, direct this invention to the use of people of all ages.

DETAILED DESCRIPTION OF THE PREFERRED EMBODIMENT

Figure 1:
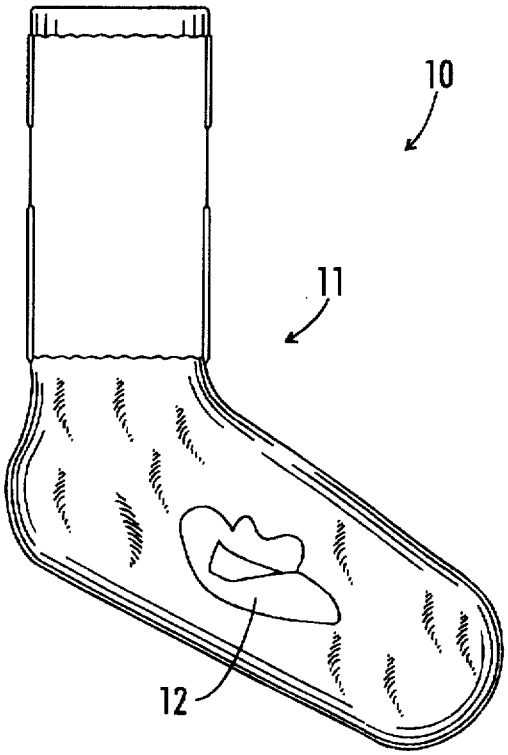
FIG. 1 is a side view of a first member of a pair of mated socks, having a decorative applique fastening patch permanently affixed to the sole of the first member of the pair of mated socks.
Figure 2:
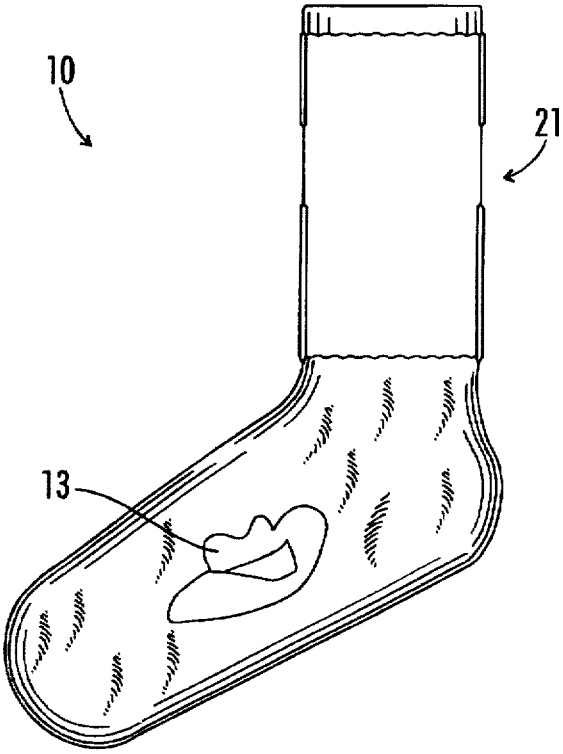
FIG. 2 is a side view of a second member of a pair of mated socks complementary to the first member of the pair of mated socks shown in FIG. 1 and having a decorative applique fastening patch permanently affixed to the sole of said second member of a pair of socks.

In FIGS. 1 and 2, there is shown a first embodiment of the invention applied to a pair of articles 10. In this embodiment, a first sock 11 and a second sock 21 have first and second decorative fastener patches 12 and 13 which are permanently attached to the sole portion of socks 11 and 12, respectively by embroidery around the periphery P and the body of the fastener, shown as a hat band 5 in FIGS. 1 and 2.

Figure 6:
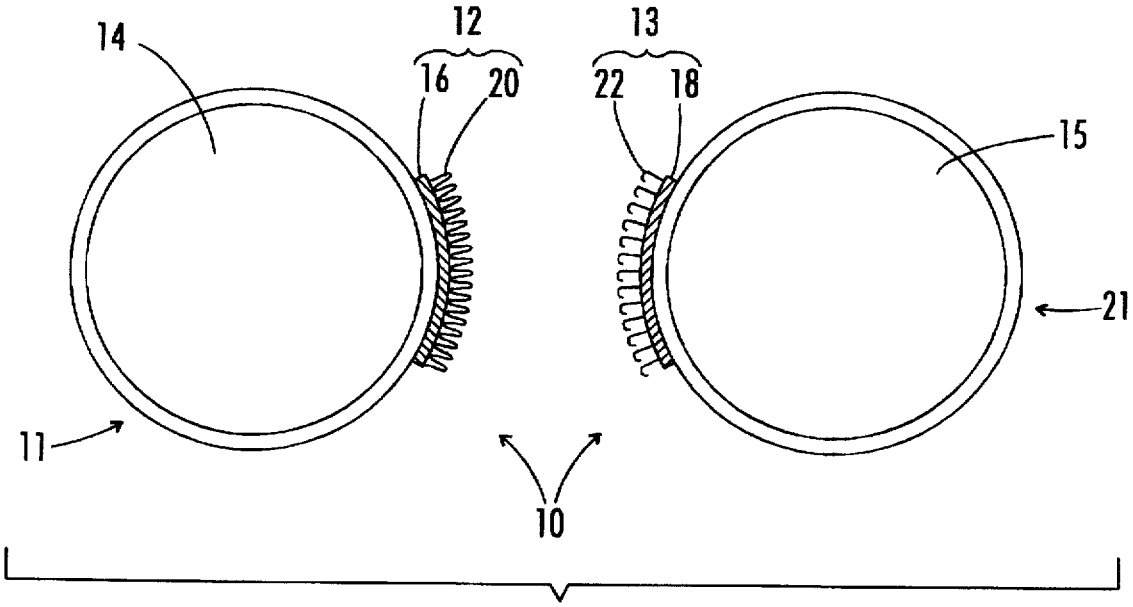
FIG. 6 is a cross-sectional top view of a pair of socks with a fastening patch adhered thereto.
Figure 9:
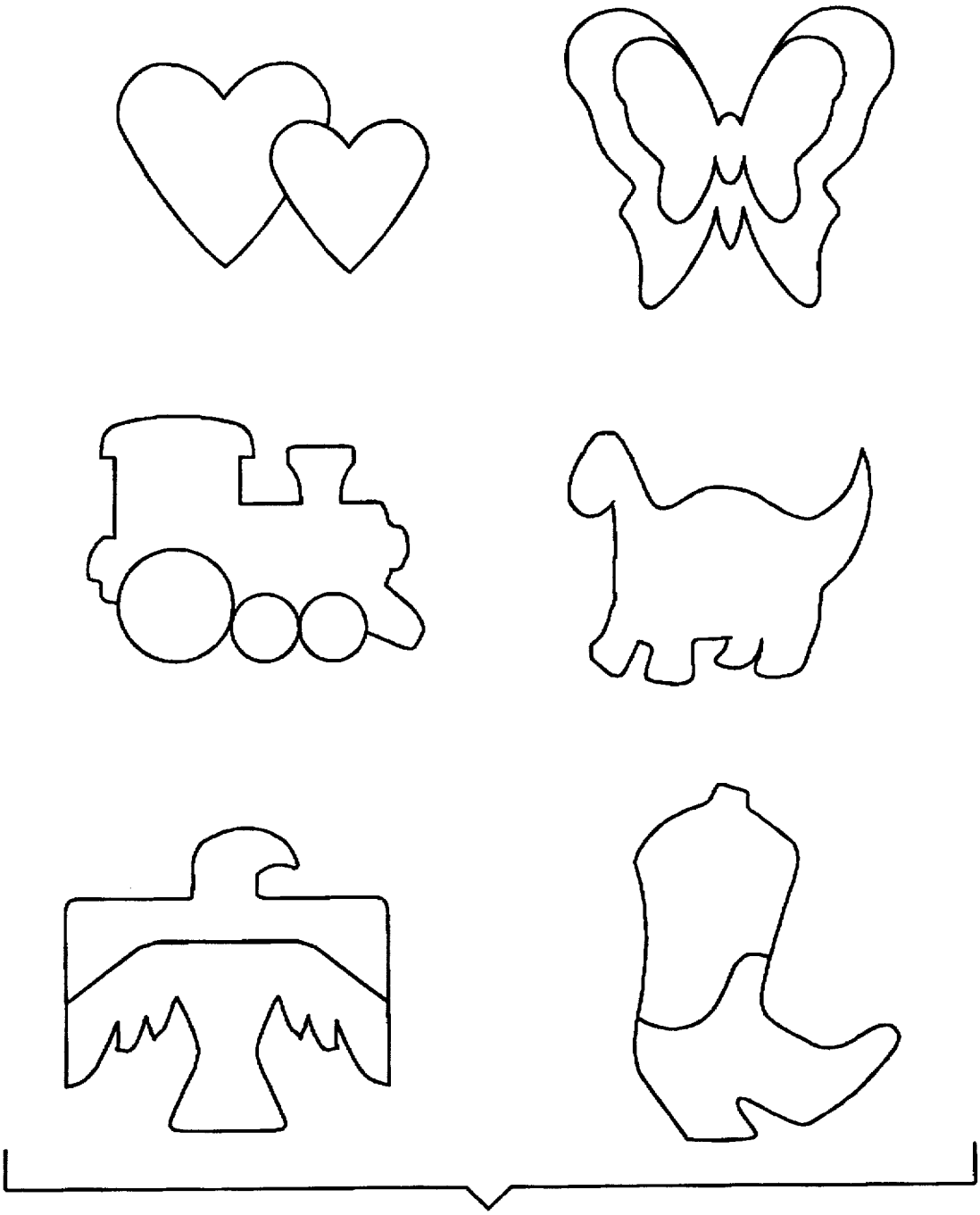
FIG. 9 shows a number of possible decorative shapes which can be used to pattern the cutting of the flexible fastening patch in a decorative manner.

Fastener patches 12, 13 may be cut in one of a wide selection of decorative shapes such as those shown in FIG. 9 having embroidered edge 40 and body sections 42. The decorative fastener patches 12 and 13 comprise flexible backings 16 and 18 having on their front surfaces either hooks 22 or loops 20 or a combination of hook or loop material for use as a fastening system which relies on the attractive nature of the hook and loop material when they are adhered together (FIG. 6).

As shown in FIGS. 1 and 2, a first fastener patch 12 is positioned in a complementary orientation to a second fastener patch 13 such that they are cut as mirror images of each other. When first sock 11 having first decorative fastener patch 12 is mated with second sock 21 having second decorative fastener patch 13, the fastener patches 12 and 13 are pressed together to form an attachment of hook-and-loop material which preferably will have a surface area of approximately 1 to 1-1/2 inch square. This surface area is sufficient to maintain a reliable and releasable bond between the two members of article pair 10, including socks, gloves or other complementary items of clothing or manufacture, during laundering or storage.

Figure 3:
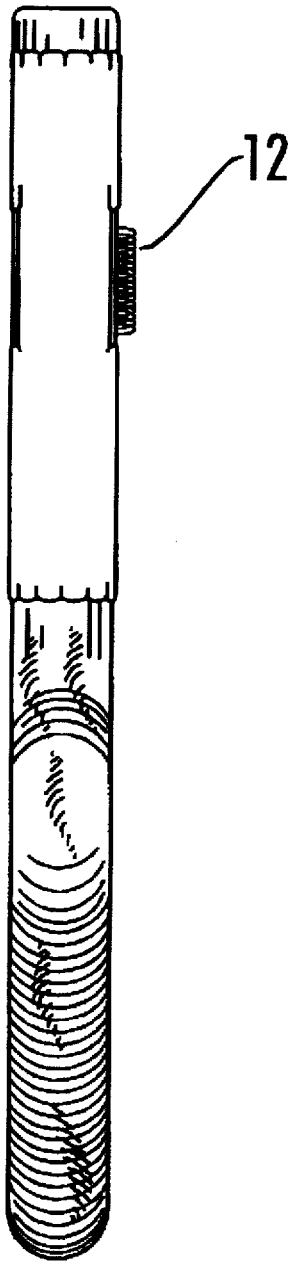
FIG. 3 is a left side elevational view having a fastener patch therein.
Figure 4:
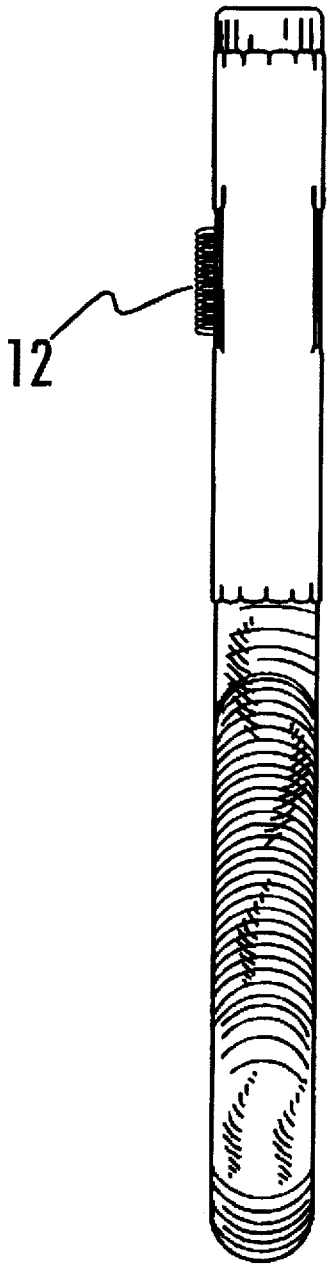
FIG. 4 is a right side elevational view having a fastener patch therein.
Figure 5:
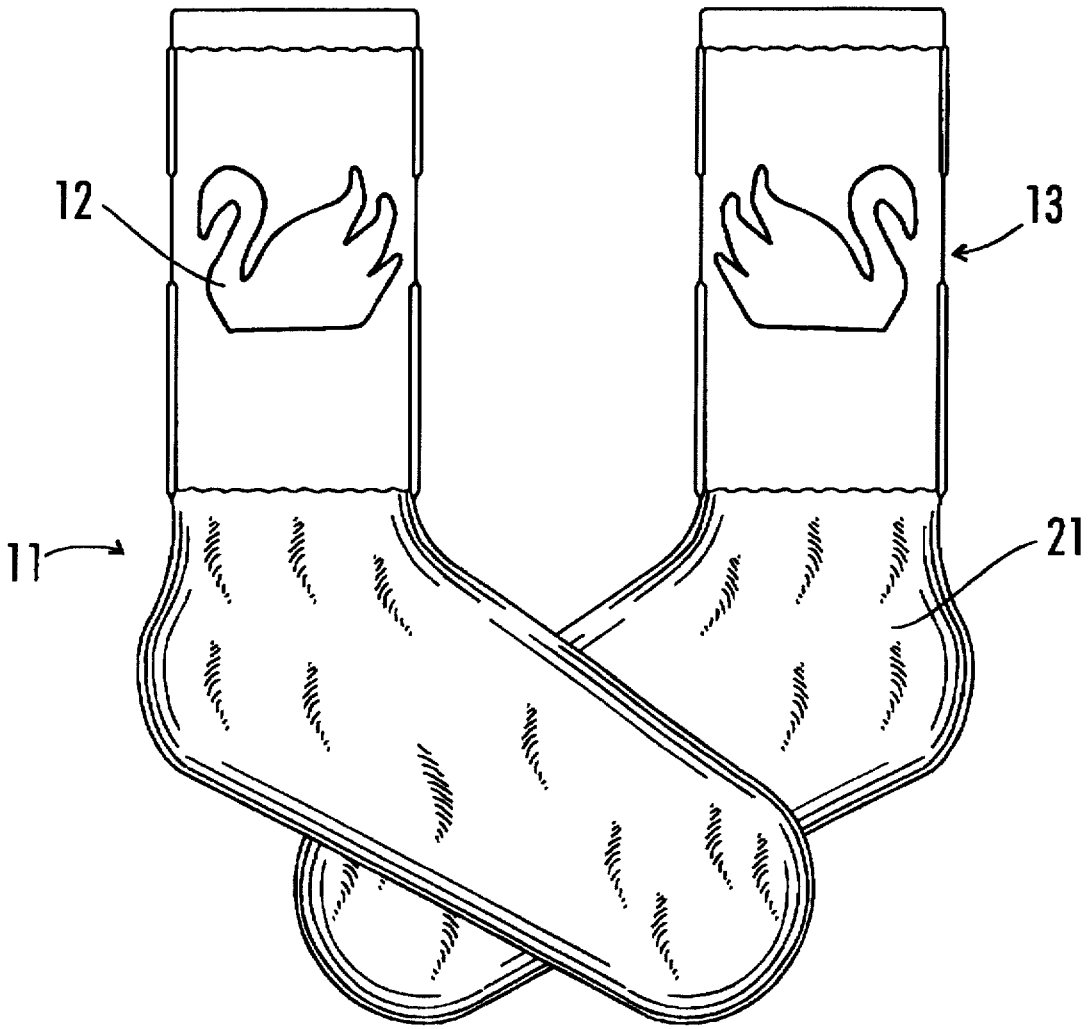
FIG. 5 is an isometric view of a pair of socks having a pair of complementary decorative applique fasteners adhered in a mirror image fashion to each other on the ankle portion of the sock.

In FIGS. 3–5, there is shown a second embodiment of the invention in which a first sock 11 and a second sock 21 have first and second decorative fastener patches 12, 13 permanently attached to the calf portion of the socks 11, 21. FIG. 5 shows an isometric view of the pair of articles 10 including a first sock 11 and a second sock 21 of FIGS. 3 and 4, and having a first decorative fastener patch 12 on first sock 11 and a second decorative fastener patch 13 on second sock 21. Again, decorative fastener patches 12 and 13 are cut in one of a wide selection of decorative shapes, including, but not limited to, those shown in FIG. 9.

The particular decorative shape of fastener patches 12 and 13 is not important. What is, however, of significance is the fact that the pair of fastener patches 12 and 13 are properly configured and attached to the sock material to resist detachment and long term use thereof. That is, with respect to FIGS. 3 and 4, the hook fastener 12 of FIG. 3 and the loop fastener 13 of FIG. 4, the embroidered edge 40 and body portions 42 raise the pile height of the fasteners. The raised pile height resists attraction to other articles of clothing during the wash and dry cycles of the article. In addition, the embroidery provides a superior means of attachment of the fasteners. The shape of the fastener patches 12 and 13, and the embroidered edges 40 and body portions 42 thereof, may form mirror images of one another.

FIG. 6 depicts a cross-sectional top of a central section of the openings 14 and 15 of first and second socks 11 and 12. The cross-sectional view in FIG. 6 of first and second decorative fastener patches 12 and 13 reveals the flexible backings 16 and 18 upon which loops 20 or hooks 22 are secured, respectively. The flexible backings 16 and 18 may have permanent adhesive affixed to their back surfaces opposite the front surfaces to which loops 20 or the hooks 22 are secured. Finally, it is also possible to sew fastener patches 12 and 13 on their respective member of article pair 10.

The fastener system may be used on a wide variety of article pairs 10. In addition, the system is useful for securing together two ends of the same article. Included among the items on which the present invention may be used are: socks (foot and ankle area), neck-ties, gloves and mittens, shoes, toys, belts, coats, shirts, sweaters, pockets, pajamas, purses, billfolds, glasses, cases, upholstery, drapes (tie-backs) and head-bands.

Figure 7:
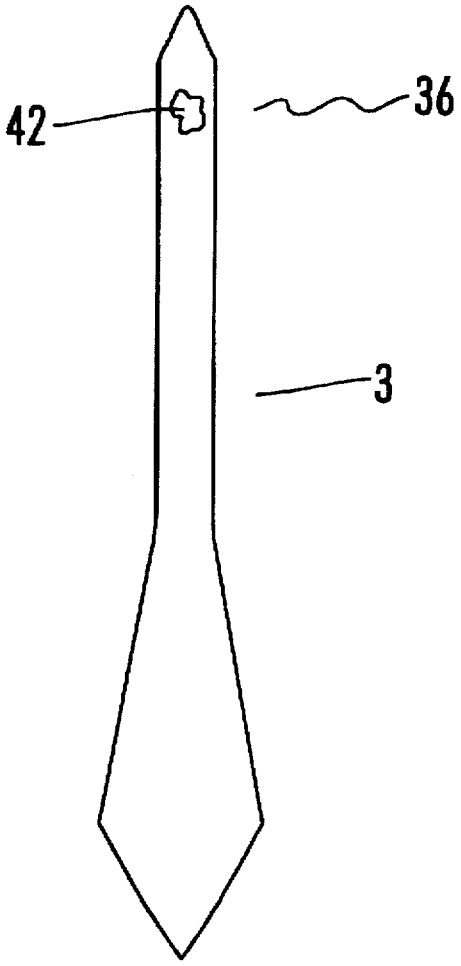
FIG. 7 is a front view of a neck-tie with a first portion of a permanently attached fastener patch.

FIG. 7 shows the front view of a neck-tie 30. At a first end 36 of neck-tie 30 and located on the front surface 32 of neck-tie 30 is a decorative shaped fastener patch 42 made of hook material. This system will aid in releasably engaging the back section of a neck-tie to the front section of a neck-tie when working in cooperation with a strip of fastener patch loop material 40 approximately 1" wide and 4" long which is permanently adhered to the back of the neck-tie.

Figure 8:
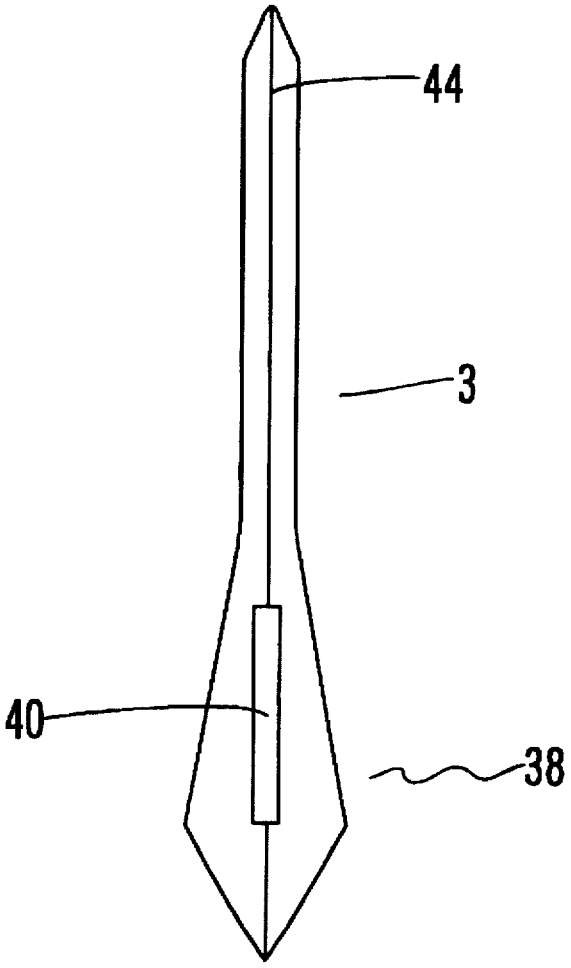
FIG. 8 is a rear view of a neck-tie with a second portion of a fastener patch complementary to that fastener patch portion shown in FIG. 7.

FIG. 8 shows the rear view of a neck-tie 30 having a seam 44. At a second end 38, there is a strip of fastener patch loop material 48 approximately 1" wide and 4" long which is permanently adhered to the back of the neck-tie. This device will aid in releasably engaging the back section of a neck-tie to the from section of the same neck-tie when working in cooperation with a decorative shaped fastener patch 49 made of hook material.

Although a number of hook-and-loop materials are available on the market today, a preferred embodiment of the present invention employs the VELCRO brand "HOOK AND LOOP FASTENERS". It is clear that further embodiments of the invention include other types and brands of hook-and-loop fasteners.

In all of the preferred embodiments the hook and loop patch is first die cut into a decorative shape, leaving a raw edge, and then appliqued to the article by computerized embroidery equipment.

Thus, although there have been described particular embodiments of the present invention of a new and useful "Embroidered Applique Fastener for Socks" it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What is claimed is:

1. A system for fastening a pair of clothing articles made of material comprising:

a. a first fastener patch having a front surface, a back surface and an edge positioned between and in communication with the front surface and the back surface of said first fastener patch;

b. said front surface of said first patch having hooks permanently affixed thereto;

c. embroidery stitching passing through the front and the back surface of said first fastener patch and through the material of a first clothing article to fasten the first fastener patch to the material;

wherein said embroidery stitching is contained solely within the from surface and the back surface of said first fastener patch and away from the edge to provide a secure attachment of said first fastener patch to the first clothing article;

d. a second fastener patch having a front surface and a rear surface and an edge positioned between and in communication with the front surface and the rear surface of said second fastener patch;

e. said front surface of said second fastener patch having loops permanently attached thereon, said loops being complementary and releasably attachable to said hooks of said first fastener patch; and f. embroidery stitching passed through the front surface and the rear surface of said second fastener patch and through the material of a second clothing article to fasten the patch to the material;

wherein said embroidery stitching is contained solely within the front surface and the rear surface of said second fastener patch and away from the edge to provide a secure attachment of said second fastener patch to the second clothing article;

g. wherein the embroidery of each of said first fastener patch and the embroidery of said second fastener patch lies below a height associated with the hooks and the loops, respectively, to enable the embroidery of said first fastener patch and the embroidery of said second fastener patch to form a matched set of embroidery stitching with respect to the first and second articles of clothing allowing the matched set of embroidery stitching to have a collective thickness less than or equal to the thickness associated with the hook and loop portions of the first fastener patch and second fastener patch when they are pressed together in cooperating engaging contact.

2. The system for fastening said pair of articles as in claim 1, wherein said first and second clothing articles comprise first and second socks.

3. The system for fastening said pair of articles as in claim 1, said first fastener patch and said second fastener patch comprising complementary decorative shapes to enable a proper mating association between the first article of clothing and the second article of clothing to ensure consistent wear of both articles.

4. The system for fastening said pair of articles an in claim 1, wherein the embroidery stitching of said fastener patch and the embroidery stitching of said second fastener patch are complementary.

5. The system for fastening said pair of articles as in claim 1, wherein the embroidery stitching forms a decorative pattern on said front surface of said first fastener patch and on said front surface of said second fastener patch.

6. The system for fastening said pair of articles as in claim 1, wherein each of the first and second fastener patches is in the form of an object having a shape, and the embroidery stitching passing through the fastener patch is in the form of indicia with said object.

7. A system for fastening a pair of clothing articles made of material comprising:

a. a first fastener patch having an edge interpositioned between a front surface and a back surface, and a second fastener patch having an edge interpositioned between a front surface and a back surface;

b. embroidery means for attaching the first fastener patch to the material of a first clothing article and the second fastener patch to the material of a second article of clothing;

wherein the embroidery means passes through the front and the back surfaces of the first and the second fastener patches away from their respective edges such that the embroidery stitching is contained solely within the front and the back surfaces of the first and the second fastener patches, respectively, to provide a secure attachment of the first and the second fastener patches to the first and the second clothing articles, respectively; and c. hook and loop means permanently attached to the front surface of the first patch and the front surface of the second patch, respectively, for engaging the first patch and the second patch to hold the first and second articles of clothing together, d. wherein the embroidery means of the first fastener patch and the second fastener patch each lies below a height associated with the hooks and loop means, respectively, to enable the embroidery means of the first fastener patch and the embroidery means of the second fastener patch to form a matched set with respect to the first and second articles of clothing allowing the embroidery means to have a collective thickness less than or equal to the thickness associated with the hook and loop portions of the first and the second fastener patches when they are pressed together in cooperating engaging contact.

8. The system for fastening said pair of articles as in claim 7, wherein said first and second articles of clothing comprise first and second socks.

9. The system for fastening said pair of articles as in claim 7, wherein said first fastener patch and said second fastener patch are cut in complementary decorative shapes to enable a proper mating association between the first article of clothing and the second article of clothing to ensure consistent wear both articles.

10. The system for fastening said pair of articles as in claim 7, wherein each of the first and second fastener patches is in the form of an object having a shape, and the embroidery means forms at least one feature associated with said object.

11. The system for fastening said pair of articles as in claim 7 wherein the indicia on the first fastener patch and the indicia on the second fastener patch are complementary.

12. A pair of attachable clothing articles made of cloth, comprising:

a. a first member of said pair of articles;

b. a first fastener patch having an edge positioned between and in communication with a front surface and a back surface;

c. said front surface of said first patch having hooks permanently attached thereon;

d. said first patch is attached to said first member of said pair of articles by embroidery such that said embroidery is contained solely within the front surface and the back surface of said first fastener patch and away from the edge to provide a secure attachment of said first fastener patch to the first member of said pair of clothing articles;

e. a second fastener patch having an edge positioned between and in communication with a front surface and a back surface;

f. said front surface of said second fastener patch having loops permanently attached thereon which are complementary to said hooks on said first patch; and g. said second fastener patch is attached to the second member of said pair of articles by embroidery such that said embroidery is contained solely within the front surface and the back surface of said second fastener patch and away from the edge to provide a secure attachment of said second fastener patch to the second member of said pair of clothing articles;

h. wherein the embroidery positioned on the first and the second fastener patches is complementary and each lies below a height associated with the hooks and the loops, respectively, such that the embroidery of said first fastener patch and the embroidery of said second fastener patch form a matched set of embroidery with respect to the first and the second members of said pair of articles enabling the matched set of embroidery to have a collective thickness less than or equal to the thickness associated with the hooks of the first fastener patch and the loops of the second fastener patch when said fastener patches are pressed together in cooperating engaging contact.

13. The pair of attachable articles as in claim 12, wherein a. said front surface of said first fastener patch comprises a combination of hook material and loop material; and, b. said front surface of said second fastener patch comprises a combination of loop material which is complementary to said hook material on said fastener patch and hook material which is complementary to said loop material on said first fastener patch.

14. The attachable pair of articles as in claim 12, wherein the first and second clothing articles are substantially similar.

15. The pair of attachable articles as in claim 12, wherein the embroidery on the front surface of the second fastener patch is a mirror image of the embroidery on the front surface of the first fastener patch.

* * * * *